US010829343B2

(12) United States Patent
Kuboyama

(10) Patent No.: US 10,829,343 B2
(45) Date of Patent: Nov. 10, 2020

(54) ELEVATOR CONTROL DEVICE AND METHOD FOR CONTROLLING NOTIFICATION TIMING OF ELEVATOR

(71) Applicant: MITSUBISHI ELECTRIC CORPORATION, Chiyoda-ku (JP)

(72) Inventor: Yuki Kuboyama, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 487 days.

(21) Appl. No.: 15/740,429

(22) PCT Filed: Aug. 10, 2015

(86) PCT No.: PCT/JP2015/072640
§ 371 (c)(1),
(2) Date: Dec. 28, 2017

(87) PCT Pub. No.: WO2017/026032
PCT Pub. Date: Feb. 16, 2017

(65) Prior Publication Data

US 2018/0186597 A1 Jul. 5, 2018

(51) Int. Cl.
*B66B 3/00* (2006.01)
*B66B 1/34* (2006.01)
*B66B 1/46* (2006.01)

(52) U.S. Cl.
CPC ..... *B66B 3/00* (2013.01); *B66B 1/3446* (2013.01); *B66B 1/468* (2013.01); *B66B 3/006* (2013.01);

(Continued)

(58) Field of Classification Search
CPC ..... B66B 3/00; B66B 3/006; B66B 1/3446; B66B 1/468

(Continued)

(56) References Cited

U.S. PATENT DOCUMENTS 5,271,484 A * 12/1993 Bahjat ..... B66B 1/18 187/387
5,317,114 A * 5/1994 Pullela ..... B66B 1/20 187/383

(Continued)

FOREIGN PATENT DOCUMENTS

JP 61-155178 A 7/1986
JP 5-92880 A 4/1993
JP 2002-3101 A 1/2002

OTHER PUBLICATIONS

International Search Report dated Nov. 10, 2015 in PCT/JP2015/072640 filed Aug. 10, 2015.

*Primary Examiner* — David S Warren
(74) *Attorney, Agent, or Firm* — Xsensus LLP

(57) ABSTRACT

Each of a plurality of cars includes an in-car notification device configured to receive an announcement command from one of the individual car control devices, to thereby execute an announcement of the name of its own car. When an assignment command is received from a group management device, each of a plurality of individual car control devices causes the car to perform a door opening operation after causing the car to arrive at a floor on which a user is to ride in the car, and outputs the announcement command when it is determined after the door opening operation is finished that an elapsed period of time since the reception of the assignment command is equal to or longer than a period of time required for the user to arrive at an elevator landing after registering a destination floor call on the landing operation panel.

4 Claims, 2 Drawing Sheets

(52) U.S. Cl.
CPC . *B66B 2201/212* (2013.01); *B66B 2201/4615* (2013.01)

(58) Field of Classification Search
USPC ..... 187/391
See application file for complete search history.

(56) References Cited

U.S. PATENT DOCUMENTS 6,109,396 A * 8/2000 Sirag ..... B66B 1/468 187/381
7,021,429 B2 * 4/2006 Hikita ..... B66B 1/462 187/391
7,445,090 B2 * 11/2008 Bodmer ..... B66B 1/463 187/391
7,717,238 B2 * 5/2010 Hamaji ..... B66B 1/468 187/396
8,439,169 B2 * 5/2013 Iio ..... B66B 1/468 187/387
8,505,692 B2 * 8/2013 Tokura ..... B66B 1/468 187/382
8,910,752 B2 * 12/2014 Furutani ..... B66B 3/006 187/384
10,118,797 B2 * 11/2018 Keser ..... H04W 4/33
10,696,516 B2 * 6/2020 Taniyama ..... B66B 1/16
2003/0164267 A1 * 9/2003 Hikita ..... B66B 1/462 187/391
2005/0279587 A1 * 12/2005 Bodmer ..... B66B 1/463 187/391
2009/0120727 A1 * 5/2009 Hamaji ..... B66B 1/468 187/391
2011/0127114 A1 * 6/2011 Ilo ..... B66B 1/2458 187/247
2011/0132699 A1 * 6/2011 Tokura ..... B66B 1/468 187/382
2012/0138389 A1 * 6/2012 Furutani ..... B66B 1/468 187/247
2016/0221791 A1 * 8/2016 Berryhill ..... B66B 1/2458
2017/0355554 A1 * 12/2017 Eleid ..... B66B 3/002
2018/0022572 A1 * 1/2018 Taniyama ..... B66B 1/2458 187/247
2018/0150806 A1 * 5/2018 Eleid ..... G06Q 10/20
2018/0186597 A1 * 7/2018 Kuboyama ..... B66B 1/468
2020/0130991 A1 * 4/2020 Simcik ..... B66B 1/2458

* cited by examiner

ELEVATOR CONTROL DEVICE AND METHOD FOR CONTROLLING NOTIFICATION TIMING OF ELEVATOR

TECHNICAL FIELD

The present invention relates to an elevator control device and a method of controlling a notification timing of an elevator, for notifying a user of a car to ride in.

BACKGROUND ART

A related-art general method of using an elevator follows the following steps.

(Step 1) A user operates an up call button or a down call button installed at an elevator landing to call an elevator.

(Step 2) After riding in the elevator that has arrived at the landing, the user operates a destination button installed in an elevator car to move to a desired destination floor.

In recent years, however, a new method of using an elevator has also been implemented in which the user registers a destination floor in advance on a landing operation panel, which is installed at the elevator landing or a place separate from the landing.

With an elevator system capable of achieving the latter new method, after the user's destination floor is obtained in advance, a car to be assigned to a call made from the landing operation panel can be determined. Therefore, when there are a plurality of users who register the same destination floor, the same car can be assigned to those users.

As a result, as compared to a case in which different cars are assigned to respective users, a total number of floors on which the cars stop in all the installed cars can be reduced, leading to an increase in efficiency of elevator operation.

In a case where a display is installed on the landing operation panel or in the vicinity thereof, when a user registers the destination floor, information on a car to ride in, that is, a car assigned to a call made from the landing operation panel is displayed on the display to allow the user to positively ride in the assigned car.

Further, in addition to displaying of the car information on the display, with use of the elevator by a visually impaired person in mind, an announcement issuance device is installed on the landing operation panel or in the vicinity thereof in some cases to issue an announcement of a car name from the announcement issuance device.

The user who has registered the destination floor on the landing operation panel moves to the landing, and then rides in a predetermined car. At this time, as a method of notifying the user of a car to ride in, there is a method of displaying the car name at each car landing. In addition, as another notification method, the following method is also used: when an elevator car arrives at the landing, the announcement issuance device installed at the elevator landing or in the car issues the announcement of its own car name, to thereby notify the user of the place where the car is installed.

In particular, with the use by a visually impaired person in mind, the announcement of the car name is useful. However, when the announcement is issued to notify the user of a given message, it is necessary to take care of not only details of the announcement but also a timing to issue the announcement and a volume of the announcement so that the user can hear the announcement easily.

As the related art that focuses on such a point, there has been known a technology in which the volume of the announcement is appropriately adjusted in accordance with the relationship between the position of a button installed at an elevator landing and the position of an elevator car.

CITATION LIST

Patent Literature

[PTL 1] JP 61-155178 A

SUMMARY OF INVENTION

Technical Problem

However, the related art has the following problems.

As described above, the landing operation panel, which allows the user to register the destination floor in advance, is installed at the landing close to the elevator car in some cases, whereas the landing operation panel is installed at the place separate from the landing in other cases. In addition, a first announcement issuance device installed at the landing operation panel or in the vicinity thereof announces the car name when the user registers the destination floor.

Meanwhile, a second announcement issuance device installed at the landing or in the car announces its own car name when the car assigned in response to the call made from the landing operation panel arrives at the landing. However, depending on the place where the landing operation panel is installed, the user may fail to appropriately hear the respective announcements issued by the first announcement issuance device and the second announcement issuance device.

For example, a first case is considered in which the landing operation panel is installed immediately near the elevator car, and when the destination floor is registered, a car that has already stopped at a floor on which the user is to ride in the car is assigned. In the first case, the announcements may be issued at the same time from the first announcement issuance device for notifying the user of the car to ride in and from the second announcement issuance device for notifying the user that the car assigned in response to the call made at the landing is its own car. As a result, the user may fail to hear the car to ride in.

A second case is considered in which, conversely, the landing operation panel is installed at the place separate from the landing. In the second case, after the user operates the landing operation panel, the car may arrive at the floor on which the user is to ride in the car before the user arrives at the landing. Then, when the car arrives at the floor on which the user is to ride in the car, the announcement may be issued from the second announcement issuance device for notifying the user of its own car name. As a result, there occurs a situation in which, when the user who has failed to hear the announcement issued by the second announcement issuance device arrives at the landing, the user cannot distinguish the car to ride in from other cars.

The present invention has been made in order to solve the above-mentioned problems, and it is an object of the present invention to provide an elevator control device and a method of controlling a notification timing of an elevator, which enable a user to positively hear an announcement for notifying the user of a car to ride in in an elevator system in which a landing operation panel, on which the user registers a destination floor in advance before riding in the elevator, is installed and an announcement is issued to notify the user of the car to ride in.

Solution to Problem

According to one embodiment of the present invention, there is provided an elevator control device including: a plurality of individual car control devices configured to individually perform operation control of a plurality of cars; a landing operation panel to be used by a user to register a destination floor call, which is a call of a destination floor of an elevator; and a group management device configured to: assign a car to be dispatched from among the plurality of cars to the destination floor call received from the landing operation panel; output, to one of the plurality of individual car control devices that corresponds to the assigned car, an assignment command including information on a floor on which the user who has registered the destination floor call is to ride in the assigned car and a destination floor corresponding to the destination floor call; and transmit car name information for identifying the assigned car to the landing operation panel that is a transmission source of the destination floor call, in which the landing operation panel includes an assigned car notification device configured to notify the user of the car name information received from the group management device, in which each of the plurality of cars includes an in-car notification device configured to receive an announcement command from one of the plurality of individual car control devices that performs operation control of the each of the plurality of cars, to thereby execute a car name announcement, which is an announcement of a name of the each of the plurality of cars, in which each of the plurality of individual car control devices includes: a storage unit configured to store in advance a period of time required for the user to arrive at an elevator landing of the assigned car after the user registers the destination floor call on the landing operation panel and hears the notification of the car name information by the in-car notification device; and a time measurement device configured to measure a period of time elapsed since a time point at which the assignment command is received from the group management device, and in which each of the plurality of individual car control devices is configured to, when the assignment command is received from the group management device: cause the car assigned by the group management device to perform a door opening operation after causing the assigned car to arrive at the floor on which the user is to ride in the assigned car; and output, when the elapsed period of time measured by the time measurement device is determined to be equal to or longer than the required period of time stored in the storage unit after the door opening operation is finished, the announcement command to the in-car notification device of the car assigned by the group management device.

Further, according to one embodiment the present invention, there is provided a method of controlling a notification timing of an elevator, which is executed by each of the plurality of individual car control devices in the elevator control device of the one embodiment of the present invention when the assignment command is received from the group management device, the method including: a first step of starting the measurement of the elapsed period of time by the time measurement device; a second step of causing the car assigned by the group management device to perform a door opening operation after causing the assigned car to arrive at the floor on which the user is to ride in the assigned car; and a third step of monitoring the elapsed period of time started to be measured in the first step after the door opening operation is finished in the second step, and outputting, when the elapsed period of time is determined to be equal to or longer than the required period of time stored in the storage unit, the announcement command to the in-car notification device of the car assigned by the group management device.

Advantageous Effects of Invention

According to the present invention, there is provided the configuration in which the timing to issue an announcement for notifying the user of its own car name when the car to ride in arrives at the floor on which the user is to ride in the car is appropriately adjusted so as to be synchronized with the timing at which the user arrives at the landing. As a result, it is possible to provide the elevator control device and the method of controlling a notification timing of an elevator, which enable the user to positively hear the announcement for notifying the user of the car to ride in in the elevator system in which the landing operation panel, on which the user registers the destination floor in advance before riding in the elevator, is installed and the announcement is issued to notify the user of the car to ride in.

DESCRIPTION OF EMBODIMENTS

The present invention focuses particularly on, in an elevator system in which a user registers a destination floor before riding in an elevator car, a case in which the user is notified of the name of an elevator car to ride in by a sound that is output from an announcement issuance device, and has a technical feature of allowing the user to positively hear an announcement for notifying the user of the car to ride in. Now, an elevator control device and a method of controlling a notification timing of an elevator according to a preferred embodiment of the present invention having such a technical feature are described in detail below with reference to the drawings.

First Embodiment

Figure 1:
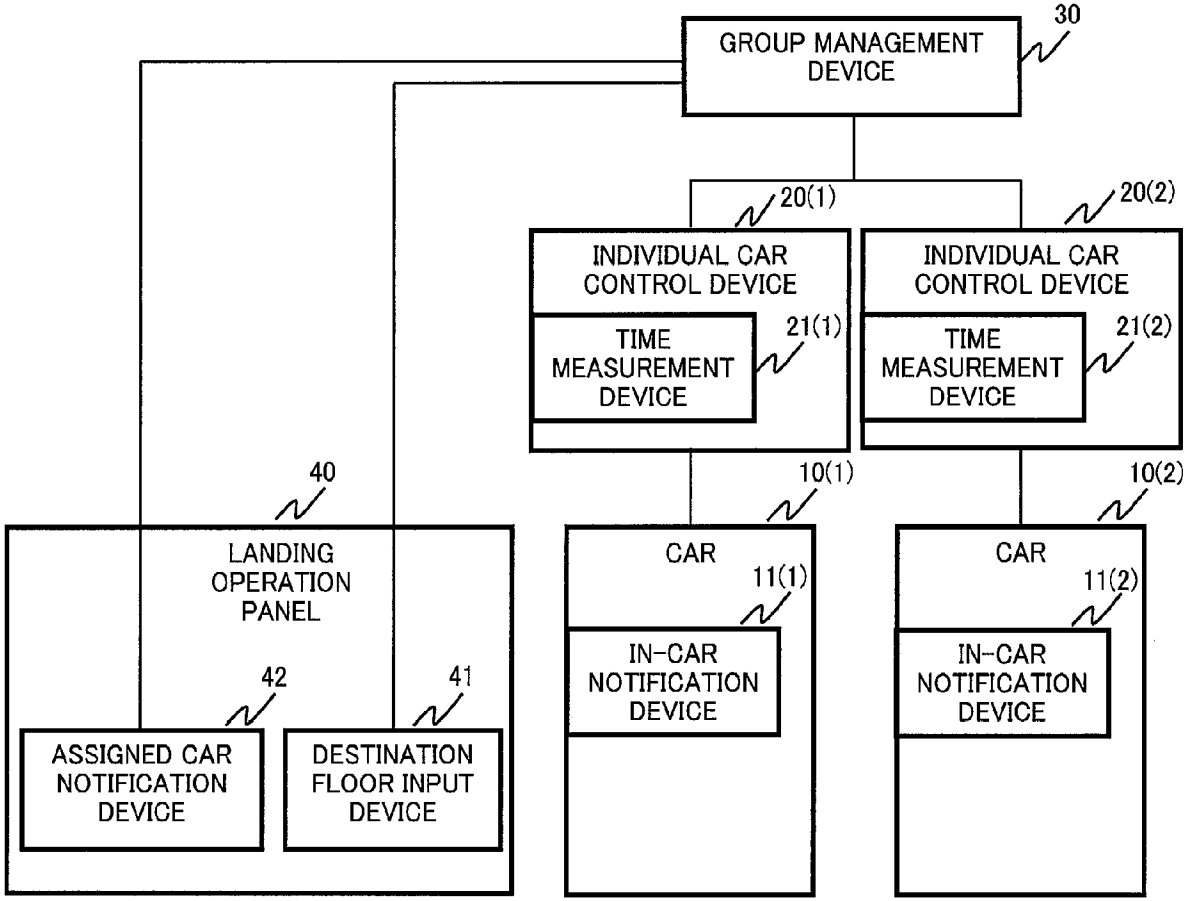
FIG. 1 is a diagram for schematically illustrating an overall configuration of an elevator system of a first embodiment of the present invention.

FIG. 1 is a diagram for schematically illustrating an overall configuration of an elevator system of a first embodiment of the present invention. The elevator system of the first embodiment includes two cars 10(1) and 10(2), individual car control devices 20(1) and 20(2) configured to individually control the respective cars, a group management device 30, and a landing operation panel 40.

In FIG. 1, a case in which the number of cars 10 and the number of individual car control devices 20 are each two is illustrated as an example, but the present invention can also be applied to a configuration in which the number of cars 10 and the number of individual car control devices 20 are each three or more. Further, the suffix enclosed by the parentheses of each reference numeral of FIG. 1 means the name of each car, and the suffixes "(1)" and "(2)" correspond to a first car and a second car, respectively. However, in the following description, when there is no need to distinguish the cars from each other, the suffix is omitted from each reference numeral.

Each of the cars 10 includes an in-car notification device 11. Each of the individual car control devices 20 includes a time measurement device 21. The landing operation panel 40 includes a destination floor input device 41 and an assigned car notification device 42.

As illustrated in FIG. 1, the destination floor input device 41 and the assigned car notification device 42, which are two components included in the landing operation panel 40, are connected to the group management device 30 via communication cables.

In the configuration of the first embodiment illustrated in FIG. 1, only one landing operation panel 40 is installed, but the configuration of the present invention is not limited thereto. For example, even when a plurality of landing operation panels 40 are installed on the same floor, or even when the landing operation panel is installed on a floor different from a floor to be used by the user, the elevator system of the present invention can also be built by connecting the landing operation panel 40 to the group management device 30 via a communication cable in the same manner as in FIG. 1. However, the following description assumes a case in which the landing operation panel 40 is installed on the same floor as the floor to be used by the user.

When an elevator user uses the destination floor input device 41 installed on the landing operation panel 40 to input a destination floor, information on the destination floor is transmitted to the group management device 30 via the communication cable. The group management device 30 determines the car 10 to be called to the floor on which the user is to ride in the car 10 based on the destination floor information received from the landing operation panel 40.

Further, the group management device 30 outputs name information on the determined car to the assigned car notification device 42 installed on the landing operation panel 40 via the communication cable. In response to this, the assigned car notification device 42 issues an announcement of a car name corresponding to the car name information received from the group management device 30.

In FIG. 1, for the sake of convenience, the communication cable connecting the group management device 30 and the destination floor input device 41 to each other and the communication cable connecting the group management device 30 and the assigned car notification device 42 to each other are individually provided, but one communication cable may be shared instead of using separate communication cables.

Further, the group management device 30 transmits, to one of the individual car control devices 20(1) and 20(2) corresponding to the car 10 that is determined based on the input of the destination floor from the landing operation panel 40, an assignment command for notifying the relevant individual car control device 20 that the car is assigned so as to be dispatched to the floor on which the landing operation panel 40 is installed.

The individual car control device 20, which has received the assignment command, executes dispatch control for moving the car 10 to the floor on which the landing operation panel 40 is installed. Next, after causing the car to arrive at the floor on which the landing operation panel 40 is installed, the individual car control device 20 opens a door of the car.

Further, after opening the door, the individual car control device 20 outputs, to the in-car notification device 11 via a communication cable, a car name announcement command for notifying the user of the name of the car that has arrived.

Meanwhile, the in-car notification device 11, which has received the car name announcement command, issues the announcement of its own car name to notify the user at the landing of its own car name.

With the elevator system described above, the elevator user, in particular, a visually impaired person, can know the name of the car to ride in through the car name announcement issued from the assigned car notification device 42 when inputting the destination floor on the landing operation panel 40.

After that, when the car to ride in arrives, by hearing the car name announcement issued from the in-car notification device 11 at the elevator landing, the elevator user can recognize that the desired car has arrived.

In this manner, by sequentially hearing two car name announcements issued from the assigned car notification device 42 and the in-car notification device 11, the elevator user can take a series of actions to use the elevator.

It is therefore important to prevent, for example, cases in which both car name announcements are issued at the same time or parts of the car name announcements are issued with overlap, and in which the car name announcement is issued from the in-car notification device 11 before the user arrives at the landing. In other words, it is necessary to appropriately adjust the timing when the latter car name announcement is issued by the in-car notification device 11.

In view of the above, in order to adjust the timing to issue the car name announcement, the individual car control device 20 of the present invention has built therein the time measurement device 21 capable of measuring a desired period of time. Specifically, the time measurement device 21 has a function of, for example, measuring the number of times an operation clock wave of a microcomputer included in the individual car control device 20 rises.

The individual car control device 20 sets a time point to start the measurement to the time measurement device 21, and acquires from the time measurement device 21 a result of measurement of the number of times the operation clock wave has risen since the time point. Then, the individual car control device 20 calculates the product of the measured number of times and a cycle of the operation clock wave, to thereby be able to obtain an elapsed period of time and determine a timing at which a desired period of time has elapsed.

Thus, based on the measurement result obtained by the time measurement device 21 and the positional relationship between an elevator landing and the landing operation panel 40, the individual car control device 20 can adjust the timing to output the car name announcement command to the in-car notification device 11. Now, an example of an algorithm relating to this timing adjustment is described next.

First, as an assumption required before details of this algorithm are described, definition of time and measurement of an elapsed period of time that are used in this algorithm are described. A period of time for which the car name announcement is issued from the assigned car notification device 42 of the landing operation panel 40 is represented by Th. Strictly speaking, a period of time for which the announcement is issued generally differs for each car name. However, such difference in time can be considered as being negligibly small, and description is given assuming that the issuance time period Th is the same for all car names.

Next, a period of time required for the user to arrive at the elevator landing from the vicinity of the landing operation panel 40 is represented by Tm. In this case, the elevator landing means a region in which the user can hear the car name announcement issued from the in-car notification device 11 when the car arrives.

The time period Tm is merely a period of time serving as a rough indication, and is a value freely set by a designer of the elevator system. For example, when the landing operation panel 40 is installed sufficiently close to the elevator in which the user is to ride, the designer may set the time period Tm as Tm=0.

Further, when the landing operation panel 40 is installed at a place separate from the elevator in which the user is to ride, for the purpose of giving consideration to users who need a long period of time to move to the landing operation panel 40, such as visually impaired persons, the designer is allowed to adjust the time period Tm to a larger value.

The time period Tm does not need to be set to a fixed value, and may be individually set depending on the position of the assigned car 10. Further, when the elevator system is capable of identifying attribute information on the user who operates the landing operation panel 40, the time period Tm may also be corrected in accordance with the attribute information. For example, when the user can be identified as a visually impaired person, the time period Tm set in advance may be corrected to become longer.

In addition, the sum of the two periods of time Th and Tm defined as described above is defined as a time period Tw. The time period Tw is a rough indication of a period of time required for the user who has operated the landing operation panel 40 to move to the elevator landing after inputting the destination floor on the destination floor input device 41 and then hearing the car name announcement issued from the assigned car notification device 42.

The individual car control device 20 uses the time measurement device 21 built therein to measure a period of time elapsed since a time point 0, with a time point at which the assignment command is received from the group management device 30 being a reference of the time point 0.

Elapsed periods of time for the cars 10(1) and 10(2) are represented by t1 and t2, respectively. However, to (n=1 or 2) is used as a general notation.

Figure 2:
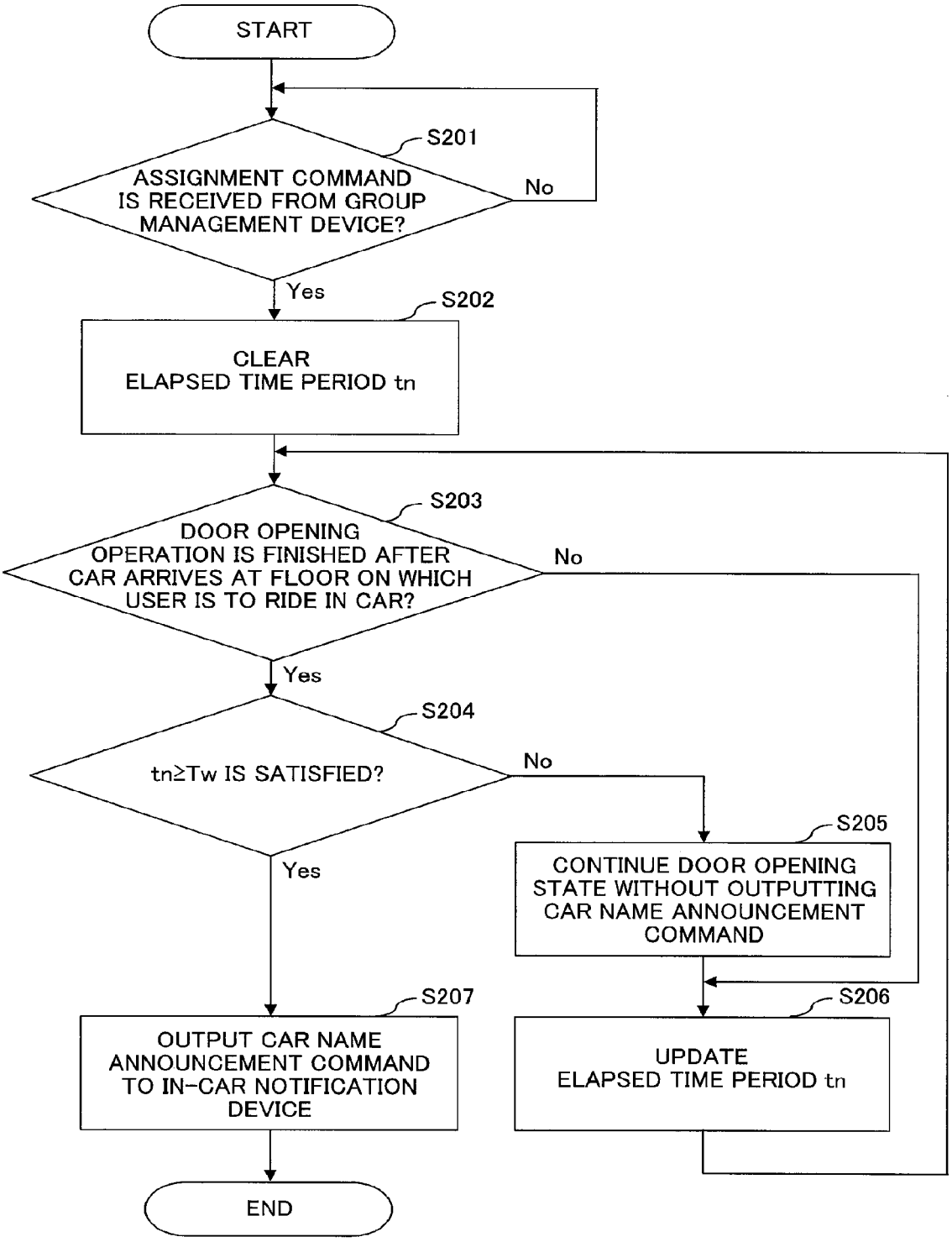
FIG. 2 is a flowchart for illustrating timing adjustment processing to be executed by an individual car control device in the first embodiment of the present invention.

On the basis of the assumption described above, a series of processing steps relating to adjustment of the timing to output the car name announcement command in the present invention is described with reference to a flowchart. FIG. 2 is a flowchart for illustrating timing adjustment processing to be executed by the individual car control device 20 in the first embodiment of the present invention. This timing adjustment processing corresponds specifically to processing of adjusting the timing to cause the in-car notification device 11 to issue the car name announcement.

First, in Step S201, the individual car control device 20 determines whether or not the assignment command is received from the group management device 30. Then, when the individual car control device 20 determines that the assignment command is received, the processing proceeds to Step S202. Meanwhile, when the individual car control device 20 determines that the assignment command is not received, the individual car control device 20 repeats the determination processing of Step S201 until the assignment command is received.

Next, when the processing proceeds to Step S202, the individual car control device 20 sets the elapsed time period tn to 0 with the time point at which the assignment command is received being set as the reference of 0.

Next, in Step S203, the individual car control device 20 performs running control of the car 10 so that the car 10 runs to the floor on which the user corresponding to the received assignment command is to ride in the car 10, and after the car arrives at the floor, the individual car control device 20 controls the door to open, and determines whether or not the door opening operation is finished. Then, when the individual car control device 20 determines that the door opening operation is not finished, the processing proceeds to Step S206. In Step S206, the individual car control device 20 updates the elapsed time period tn, and the processing returns to Step S203.

In other words, the individual car control device 20 continues the processing of Step S206 of updating the elapsed time period tn until the door opening operation is finished. Then, when the individual car control device 20 determines in Step S203 that the door opening operation is finished, the processing proceeds to Step S204. In Step S204, the individual car control device 20 compares the elapsed time period tn and the time period Tw, which is a rough indication of a period of time required for the user to move to the landing from the landing operation panel 40, to determine whether or not a relationship of tn≥Tw is satisfied.

When the relationship of tn<Tw is satisfied in Step S204, the following two possibilities are conceivable. The first possibility corresponds to a case in which because the car 10 has arrived at the floor on which the user is to ride in the car too early and then the door has been opened, at a timing corresponding to a current elapsed time period tn, the car name announcement is being issued from a landing notification device 50.

In this case, it can be considered that a relationship of tn<Th≤Tw is satisfied. Thus, in the first possibility, the individual car control device 20 determines that the car name announcement from the landing notification device 50 and the car name announcement from the in-car notification device 11 may be overlapped, and determines that it is inappropriate to output the car name announcement command to the in-car notification device 11 at the timing corresponding to the current elapsed time period tn.

Further, the second possibility corresponds to a case in which because the arrival of the car 10 at the floor on which the user is to ride in the car and the completion of the door opening operation are too early, the user has not arrived at the landing yet.

In this case, it can be considered that a relationship of Th≤tn<Tw is satisfied. Thus, also in the second possibility, the individual car control device 20 determines that the user may fail to hear the announcement from the in-car notification device 11, and determines that it is inappropriate to output the car name announcement command to the in-car notification device 11 at the timing corresponding to the current elapsed time period tn.

Accordingly, when the individual car control device 20 determines in Step S204 that the relationship of tn≥Tw is not satisfied, the processing proceeds to Step S205, and the individual car control device 20 continues the door opening state without outputting the car name announcement command. Further, the processing proceeds to Step S206, and the individual car control device 20 updates the elapsed time period tn. Then, the processing returns to Step S203.

Meanwhile, when the individual car control device 20 determines in Step S204 that the relationship of tn≥Tw is satisfied, the individual car control device 20 can determine that the issuance of the car name announcement by the landing notification device 50 is already finished and the user has already arrived at the landing. Thus, in this case, the processing proceeds to Step S207, and the individual car control device 20 outputs the car name announcement command to the in-car notification device 11, and terminates the series of processing steps.

In this way, through the execution of the series of processing steps illustrated in FIG. 2, the individual car control device 20 can adjust the timing to output the car name announcement command to the in-car notification device 11 to an appropriate time point.

As a result of the execution of such timing adjustment, a timing to issue another announcement message from the in-car notification device 11 and the timing to issue the car name announcement may be overlapped. In this case, it is necessary to control the order of announcements on the in-car notification device 11 side by, for example, causing the car name announcement to be issued after another announcement message is issued.

As described above, according to the first embodiment, there is provided the configuration in which the timing to output the car name announcement command from the individual car control device to the in-car notification device can be adjusted to an appropriate time point. In other words, there is provided the configuration in which the timing to issue the announcement of its own car name when the car to ride in arrives at the floor on which the user is to ride in the car can be appropriately adjusted so as to be synchronized with the timing at which the user arrives at the landing.

As a result, in the elevator system in which the landing operation panel, on which the user registers the destination floor in advance before riding in the elevator, is installed and the announcement is issued to notify the user of the car to ride in, the user can positively hear the announcement for notifying the user of the car to ride in. Thus, convenience of the elevator system can be enhanced.

The invention claimed is:

1. An elevator control device, comprising:

a plurality of individual car control devices configured to individually perform operation control of a plurality of cars;

a landing operation panel to be used by a user to register a destination floor call, which is a call of a destination floor of an elevator; and a group management device configured to:

assign a car to be dispatched from among the plurality of cars to the destination floor call received from the landing operation panel;

output, to one of the plurality of individual car control devices that corresponds to the assigned car, an assignment command including information on a floor on which the user who has registered the destination floor call is to ride in the assigned car and a destination floor corresponding to the destination floor call; and transmit car name information for identifying the assigned car to the landing operation panel that is a transmission source of the destination floor call, wherein the landing operation panel comprises an assigned car notification device configured to notify the user of the car name information received from the group management device, wherein each of the plurality of cars comprises an in-car notification device configured to receive an announcement command from one of the plurality of individual car control devices that performs operation control of the each of the plurality of cars, to thereby execute a car name announcement, which is an announcement of a name of the each of the plurality of cars, wherein each of the plurality of individual car control devices comprises:

a storage unit configured to store in advance a period of time required for the user to arrive at an elevator landing of the assigned car after the user registers the destination floor call on the landing operation panel and hears the notification of the car name information by the in-car notification device; and a time measurement device configured to measure a period of time elapsed since a time point at which the assignment command is received from the group management device, and wherein each of the plurality of individual car control devices is configured to, when the assignment command is received from the group management device:

cause the car assigned by the group management device to perform a door opening operation after causing the assigned car to arrive at the floor on which the user is to ride in the assigned car; and output, when the elapsed period of time measured by the time measurement device is determined to be equal to or longer than the required period of time stored in the storage unit after the door opening operation is finished, the announcement command to the in-car notification device of the car assigned by the group management device.

2. An elevator control device according to claim 1, wherein when receiving the announcement command during a period in which the in-car notification device is executing a notification operation different from the car name announcement, the in-car notification device executes the car name announcement after the notification operation is finished.

3. A method of controlling a notification timing of an elevator, which is executed by each of the plurality of individual car control devices in the elevator control device of claim 1 when the assignment command is received from the group management device, the method comprising:

a first step of starting the measurement of the elapsed period of time by the time measurement device;

a second step of causing the car assigned by the group management device to perform a door opening operation after causing the assigned car to arrive at the floor on which the user is to ride in the assigned car; and a third step of monitoring the elapsed period of time started to be measured in the first step after the door opening operation is finished in the second step, and outputting, when the elapsed period of time is determined to be equal to or longer than the required period of time stored in the storage unit, the announcement command to the in-car notification device of the car assigned by the group management device.

4. A method of controlling a notification timing of an elevator, which is executed by each of the plurality of individual car control devices in the elevator control device of claim 2 when the assignment command is received from the group management device, the method comprising:

a first step of starting the measurement of the elapsed period of time by the time measurement device;

a second step of causing the car assigned by the group management device to perform a door opening operation after causing the assigned car to arrive at the floor on which the user is to ride in the assigned car; and a third step of monitoring the elapsed period of time started to be measured in the first step after the door opening operation is finished in the second step, and outputting, when the elapsed period of time is determined to be equal to or longer than the required period of time stored in the storage unit, the announcement command to the in-car notification device of the car assigned by the group management device.

* * * * *